US005786043A

United States Patent [19]

Lindgren

[11] Patent Number: 5,786,043

[45] Date of Patent: Jul. 28, 1998

[54] DECORATIVE DEVICE AND METHOD OF MAKING THE DEVICE

[76] Inventor: Linda L. Lindgren, 41 Nut Plains Rd. West, Guilford, Conn. 06437

[21] Appl. No.: 719,350

[22] Filed: Sep. 25, 1996

[51] Int. Cl.[6] ..... A41G 1/00

[52] U.S. Cl. ..... 428/4; 156/61; 156/70; 428/24; 428/101

[58] Field of Search ..... 428/4, 5, 7, 24, 428/101; 156/61, 70

[56] References Cited

U.S. PATENT DOCUMENTS

| | | | |
|---|---|---|---|
| 3,068,487 | 12/1962 | Hain | 428/4 X |
| 3,143,259 | 8/1964 | Paar | 428/5 X |
| 3,479,243 | 11/1969 | Doig | 428/5 |
| 4,525,394 | 6/1985 | Standley | 428/26 |
| 4,627,640 | 12/1986 | Markovics | 428/4 X |
| 4,937,106 | 6/1990 | Eliason | 428/4 |
| 5,144,728 | 9/1992 | Hagenbuch | 428/4 X |

FOREIGN PATENT DOCUMENTS 442603 4/1927 Germany .

*Primary Examiner*—Henry F. Epstein
*Attorney, Agent, or Firm*—Murtha, Cullina, Richter & Pinney LLP

[57] ABSTRACT

A decorative device is disclosed having a pair of ties and a plurality of individual decorative elements including a primary component joining the ties intermediate their ends with the remaining elements being independently movable along their respective tie relative to the primary element to be gathered into adjacent relation to one another, trailing ends of the ties being attachable to one another, forming an assembled ornamental object.

17 Claims, 5 Drawing Sheets

DECORATIVE DEVICE AND METHOD OF MAKING THE DEVICE

FIELD OF THE INVENTION

This invention generally relates to an ornamental device for use in the craft industry, or as a floral decoration on packaging, a gift box or clothing such as corsages and pom-poms, or for party decor or similar applications and specifically concerns a decorative device of the type that may be distributed or shipped in a flat collapsed condition before use and before being expanded into a full-formed ornamental object.

BACKGROUND OF THE INVENTION

A variety of ornamental assemblies or decorative devices may be found in the prior art. Those conventional devices which are capable of being packaged and distributed in a flat condition prior to being assembled frequently are found to be of a construction which is relatively complex or one which is not convenient to make or quick and easy to assemble into a fully-formed device of desired appearance.

OBJECTS OF THE INVENTION

Accordingly, a primary object of this invention is to provide a new and improved device which is not only quick and easy to use but may be readily manufactured to be packaged and distributed in a flat collapsed condition for facile assembly as a full-formed decorative object.

Another object of this invention is to provide such a new and improved device which is particularly suited to be used with a variety of decorative elements of different shapes and materials.

Yet another object of this invention is to provide a new and improved method of making a decorative device which is quick and easy to implement in a simple cost effective process to ensure an end product of aesthetically pleasing appearance.

Other objects will be in part obvious and in part pointed out more in detail hereinafter.

SUMMARY OF THE INVENTION

A decorative device of this invention comprises longitudinally extending tie means and a plurality of discrete decorative elements, the elements including a primary component joining the tie means at a common point intermediate its ends. The tie means supports the remaining elements for independent sliding movement toward and away from the primary component, the elements being slidable into adjacent relation to one another about the primary component, and the ends of the tie means being attachable to one another for securing the elements in desired position to form an ornamental object.

This invention also includes a method of making a decorative device comprising the steps of providing longitudinally extending tie means and a plurality of discrete decorative elements including a primary component to be collectively formed into a decorative device, joining the tie means intermediate its ends by connecting them to the primary component, attaching the remaining elements to the tie means for individual sliding movement, sliding the elements on the tie means toward the primary component, and then securing the tie means with the elements gathered about the primary component and forming an assembled decorative device.

A better understanding of the objects, advantages, features, properties and relations of the invention will be obtained from the following detailed description and accompanying drawings which set forth certain illustrative embodiments and are indicative of the various ways in which the principles of the invention are employed.

DETAILED DESCRIPTION OF PREFERRED EMBODIMENTS AND METHOD

Figure 1:
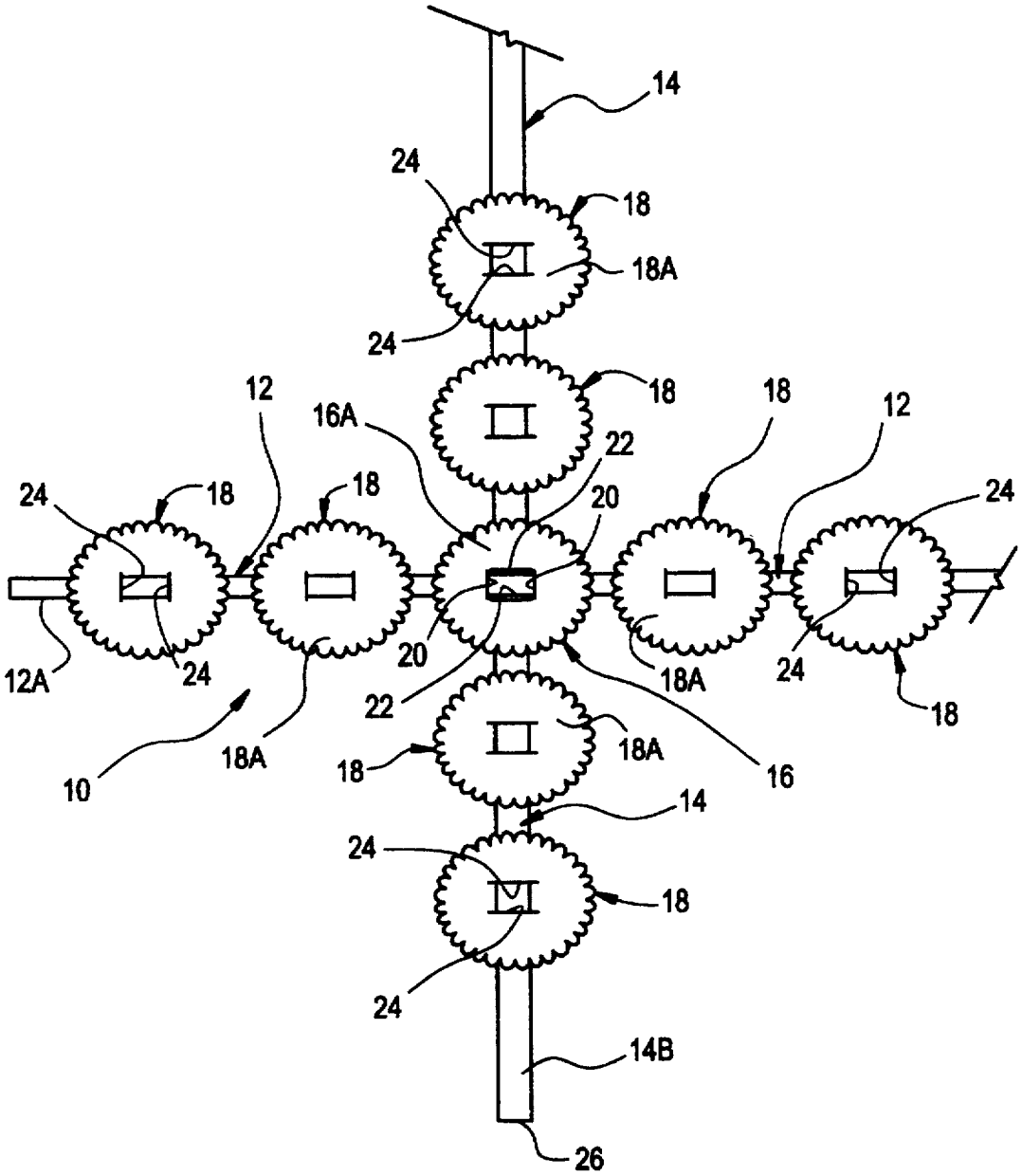
FIG. 1 is a top plan view, partly broken away, of one embodiment of the invention with its elements shown in a preassembled position.

Referring now to the drawings in detail, a first embodiment of the device 10 of this invention is illustrated in FIG. 1 in a preassembled position. A pair of ties are shown at 12 and 14 which are interconnected by a decorative primary component or center element 16 with a plurality of additional decorative elements such as at 18 supported on the ties 12, 14 extending from that center element 16. It is to be understood that the ties 12, 14 may be formed of string, yarn, ribbon, wire, tape strips or other suitable longitudinally extending, pliable material and that their respective lengths are determined by the number of the individual elements being supported. The number of elements 18 on each side of the center element 16 may also vary depending upon the type and style of the decorative device desired.

The elements themselves may be made of different materials such as paper, silk, cotton, plastic, non-woven materials and the like, and the shapes of the individual elements may be of any variety such as square, rectangular, circular, triangular or of a shape depicting a particular object such as a firecracker, an animal, a heart, a cone and the like. For purposes of this description, the embodiment of FIG. 1 will be understood to include a pair of flexible strips of tape forming the ties, and the elements themselves are illustrated as being of circular configuration having an irregular serrated periphery.

For the purposes of quickly and easily joining the first and second ties shown in the form of two strips 12, 14 of tape in FIG. 1, the center element 16 is formed with two pairs of parallel slits, the first pair of slits being illustrated at 20, 20 and disposed in perpendicular relation to the second pair of slits shown at 22, 22. The strips 12 and 14 respectively extend through the first and second pairs of slits 20, 20 and 22, 22 and are joined by the center element 16 with the ties overlying the primary component between its slits in lapping intersecting relation to one another. A full-bodied ornamental object is achieved by the provision of the remaining elements 18 being supported on the strips of tape extending outwardly from four sides of the center element 16 with the strips 12, 14 each being woven through a pair of parallel slits such as at 24, 24 in each remaining element 18 and having the strip overlie the front of each of the elements between its slits. By this construction each of the elements 18 is supported on its strip with the strip overlying a portion of the exposed front face 18A of each element between its slits 24, 24. The elements 18 on each side of the center element 16 are shown arranged with the front faces 1 8A of the elements 18 and front face 1 6A of center element 16 uniformly facing upwardly in a common direction in the preassembled position illustrated in FIG. 1 and with each of the elements having its front face maintained on top of the interconnecting strips 12, 14.

In the disclosed method of making the device of this invention, it will be seen that this particular decorative device 10 may be readily made by providing tie means including a pair of ties such as strips 12, 14 and a plurality of discrete decorative elements 18 including the primary component or center element 16 to be collectively formed into a decorative device. Joining of the strips intermediate their ends is effected by connecting them to the center element 16 and attaching the remaining elements 18 to the strips 12, 14 for individual sliding movement. The strips and elements may be packaged and shipped in the preassembled position as illustrated in FIG. 1 in a flat collapsed condition. Thereafter the making of the device is completed by sliding the elements 18 on the strips 12, 14 toward the center element 16 and then securing the strips 12, 14 with the elements 18 gathered about the center element 16 to form an assembled ornamental device. When sliding the elements 18 from the illustrated preassembled position (FIG. 1) toward the primary element 16, the elements 18 may be adjusted as needed while keeping the elements on top of the strips and gently shaping the elements into a ready position with the elements gathered in adjacent relation to one another about the center element. In the illustrated embodiment, the elements will be understood to be arranged on the strips with the back of each element confronting its respective strip and with the front faces 16A, 18A of the elements exposed. Upon gathering the elements in adjacent relation to one another about the primary component 16 in an assembled position, the trailing ends of the strips 12, 14 are attached to one another on the back of the device which is then secured.

Were it desired to use only one strip of tape in making the device of this invention, a leading end such as at 26 of a single strip of tape may be inserted through the slits 20, 20 of center element 16. A selected number of elements 18 then may be mounted on the tape by weaving its leading end 26 through their slits 24, 24 before extending the leading end 26 through the other pair of slits 22, 22 in the center element 16. Then additional elements may be mounted on both the leading end portion such as at 14B and the trailing end portion 12A of the tape, whereby elements 18 are supported on tape strips 12, 14 extending from four sides of the center element 16. The elements 18 are then gathered about the center element 16 and formed in a desired shape upon securing the tape strips.

Figure 2:
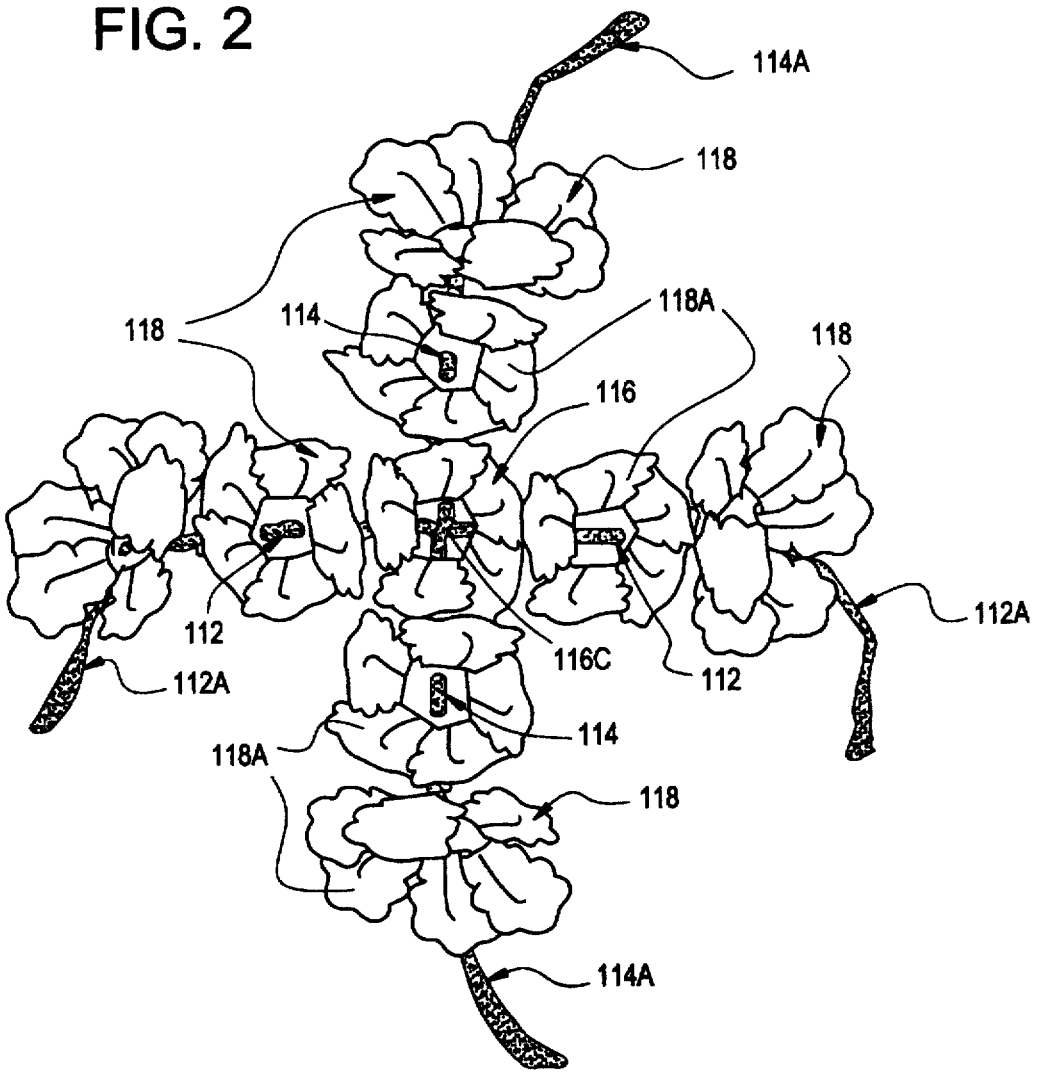
FIG. 2 is a top plan view of another embodiment of the invention with its elements shown in a preassembled position.
Figure 3:
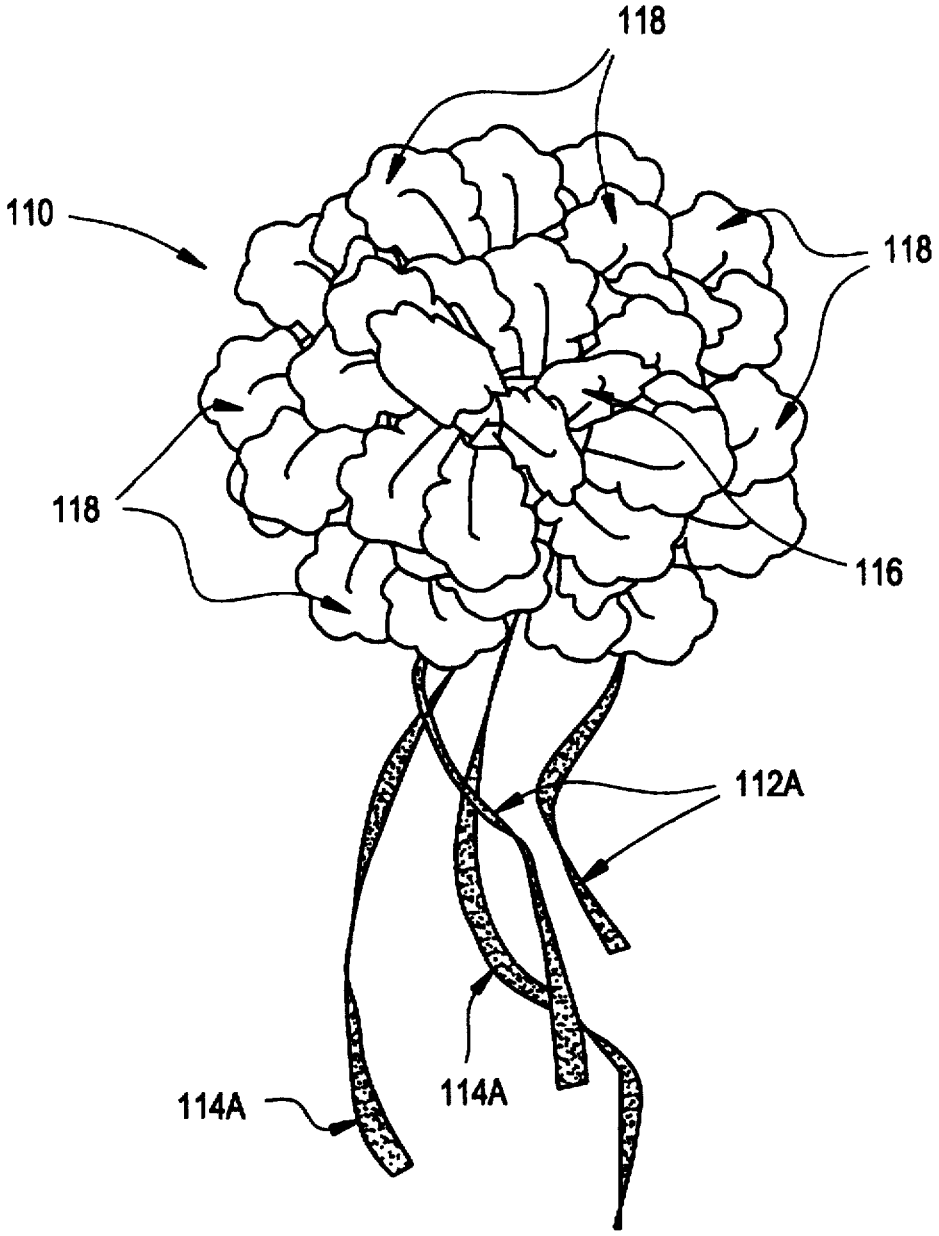
FIG. 3 is a perspective view of the embodiment of FIG. 2 shown formed into an assembled decorative device.

In a second embodiment of this invention illustrated in FIG. 2, elements 118 are shown in the form of flower petals, each having a convoluted configuration and supported on ties shown in the form of ribbons 112, 114. A primary component or center petal 116 joins the ribbons and maintains them at a common central point 116C in generally perpendicular relation to one another. The center petal 116 will be understood to have two pairs of parallel slits as described in the embodiment of FIG. 1 through which the ribbons 112 and 114 extend and overlie the center petal 116 between its slits in lapping intersecting perpendicular relation to one another. After the ribbons are joined intermediate their ends upon being connected to the center petal 116, the remaining petals 118 are then attached to the ribbons 112, 114 for individual sliding movement in accordance with the method of this invention upon weaving the ribbons through a pair of slits in the remaining petals with the ribbon overlying a center portion of each petal between its slits. The petals then are in preassembled position (FIG. 2) with the front face 118 of the petals uniformly disposed on their ribbons in position to be gathered by sliding the petals 118 toward the center petal 116 and into a ready position (FIG. 3) wherein the petals are in adjacent relation to one another and shaped about the center petal 116 by lifting the petals 118 as needed. Thereafter ends 11 2A, 14A of the ribbons 112, 114 may be tied together on the back of the flower, stapled or otherwise attached to secure the device 110.

Figure 4:
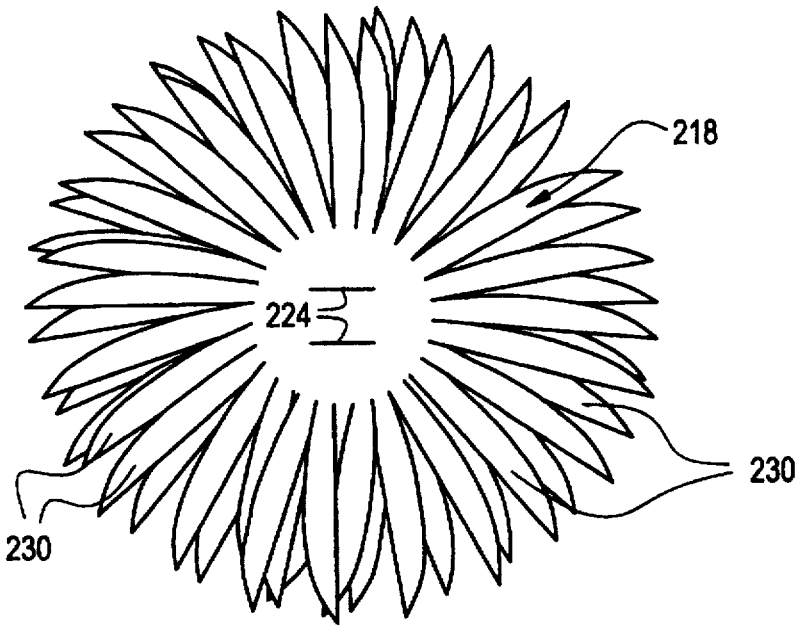
FIG. 4 is a top plan view of an alternative embodiment of an element which may be used in the decorative device of FIGS. 1 or 2.
Figure 5:
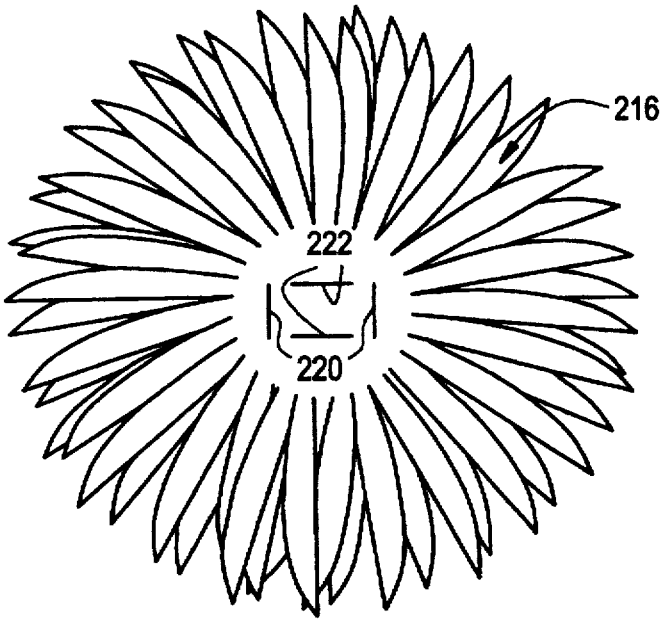
FIG. 5 is a top plan view of an alternative embodiment of a primary component which may be used in the decorative devices of FIGS. 1 or 2.

By virtue of the above described structure wherein discrete elements or petals, e.g., are individually mounted for sliding movement on their respective tie relative to the primary component or center piece, this device is particularly suited to provide a full-bodied ornamentally shaped object even from irregular pieces or undulating elements which may otherwise separate and result in a flawed appearance in more conventional devices. Even elements 218 having a multiplicity of individual radially extending petals such as shown at 230 in FIG. 4 and the corresponding center primary component 216 with the two pairs of tie-receiving slits 220, 220 and 222, 222 illustrated in FIG. 5 are readily accommodated in the disclosed structure and method of this invention upon mounting the elements 218 with its parallel slits 224 through which the ties (not shown) extend for independent sliding movement of those elements 218 on the ties relative to the center primary component 216.

Figure 6:
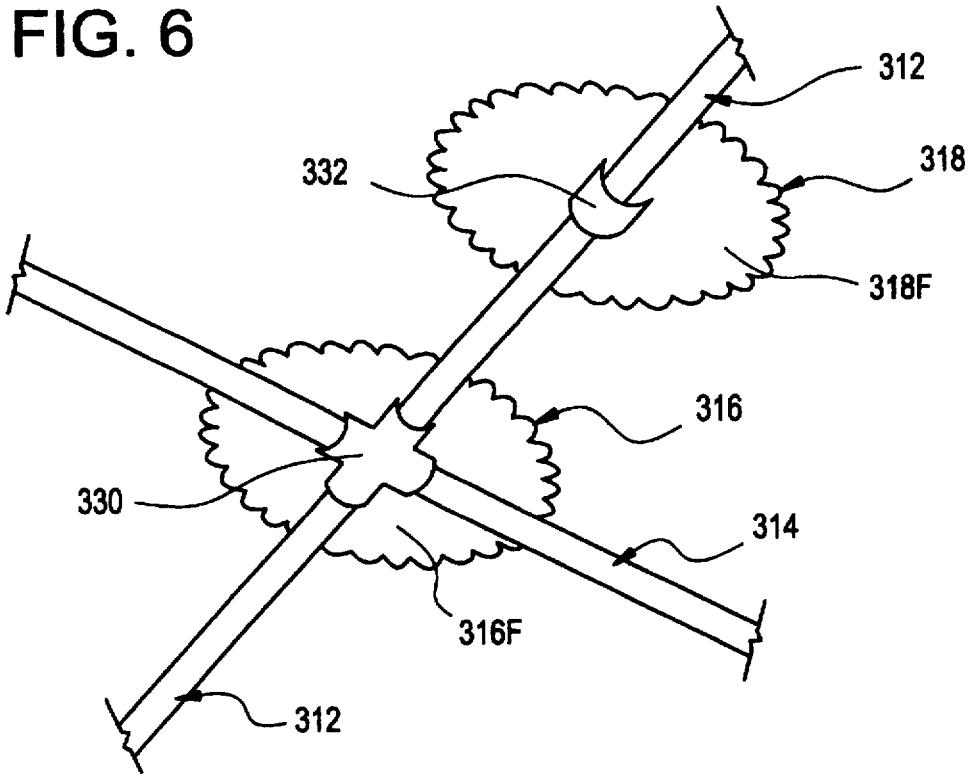
FIG. 6 is a perspective bottom view, partly broken away, showing a primary component and an element of the device interconnected by ties.
Figure 7:
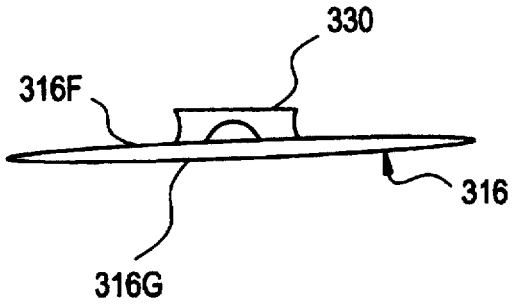
FIG. 7 is a side view of a primary component shown in FIG. 6.
Figure 8:
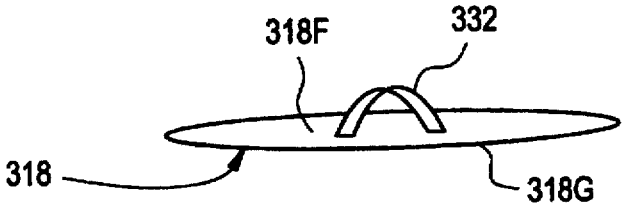
FIG. 8 is a perspective bottom view of an element shown in FIG. 6.

The versatility of this invention is further illustrated in the embodiment of FIG. 6. The elements shown at 316, 318 are similar to those of FIG. 1 and are of an irregular peripheral configuration, but in this embodiment attachments 330, 332 are provided on the elements 316, 318 for supporting the elements on the tie 312, 314 with the back or bottom face 316F and 318F of each element confronting its respective ties or tie. As shown in FIG. 6, which is a bottom view of an element 318 and adjacent primary component 316, the attachments 332, 330 are integrally formed on the back 318F, 316F of the elements 318 and primary component 316 through which the supporting ties extend. The front or upper face 316G of the primary component 316 and the upper faces such as 318G of the remaining elements 318 each will be understood to be imperforate. Attachments 330 and 332 are best seen as being integrally formed on the back 316F of the primary component 316 in FIG. 7 and the back 318F of the remaining elements such as that illustrated at 318 in FIG. 8.

Accordingly it will be appreciated that the disclosed invention provides a decorative device which may be made from a variety of different irregularly shaped elements and with different materials being used for both the elements and the ties. The product is suited to be readily packaged and distributed in a flat collapsed condition and is easy to form into a finished product of aesthetically pleasing appearance in a method which is quick and easy to implement.

Although this invention has been illustrated and described with respect to exemplary embodiments thereof, it should be understood by those skilled in the art that various changes, omissions and additions may be made without departing from the spirit and scope of the invention.

I claim:

1. A decorative device comprising longitudinally extending tie means having terminal ends, and a plurality of discrete decorative elements, the elements including a primary component joining the tie means at a common point of intersection of portions of the tie means intermediate the terminal ends of the tie means, the portions of the tie means each supporting a plurality of discrete elements for independent sliding movement relative to the primary component, the elements being slidable into adjacent relation to one another along their respective portion of the tie means in surrounding relation to the primary component, and the terminal ends of the tie means being attachable to one another for securing the elements in desired position to form an ornamental object.

2. The device of claim 1 wherein the primary component maintains portions of the tie means at said common point in generally perpendicular relation to one another.

3. The device of claim 1 wherein the tie means includes first and second ties which pass through the primary component and intersect one another at said common point.

4. The device of claim 1 wherein the tie means and the primary component are slidable relative to one another for adjusting the common point at which the primary component joins the tie means.

5. The device of claim 1 wherein the elements each are of irregular peripheral configuration and include a front, a back and an attachment on the back for receiving the tie means.

6. The device of claim 5 wherein the front of each of the elements is imperforate.

7. The device of claim 1 wherein the tie means includes first and second ties joined at said common point by the primary component, wherein the elements each are of irregular peripheral configuration and include a front and a back, the elements being slidable on the ties from a preassembled position, wherein the elements are arranged on the ties with the back of each element confronting its respective tie and with the fronts of the elements exposed, to an assembled position wherein the elements are gathered in adjacent relation to one another about the primary component with trailing ends of the ties attached to one another and securing the device.

8. The device of claim 1 wherein the primary component includes first and second pairs of parallel slits, the first pair of slits being disposed in perpendicular relation to the second pair of slits, the tie means extending through the first and second pairs of slits and being joined by the primary component.

9. The device of claim 8 wherein the tie means includes first and second portions which overlie the primary component between its slits in lapping intersecting relation to one another.

10. The device of claim 8 wherein each of the remaining elements is formed with a pair of parallel slits for receiving the tie means, the tie means being woven through the slits in the elements on four sides of the primary component.

11. The device of claim 10 wherein each of the elements has a front and a back, and wherein the tie means extends through the slits in the elements supported thereon with the tie means overlying the front of each element between its slits.

12. A method of making a decorative device comprising the steps of providing longitudinally extending tie means and a plurality of discrete decorative elements including a primary component to be collectively formed into an ornamental object, joining the tie means intermediate its terminal ends by connecting portions of the tie means to the primary component to form an intersecting point, attaching the remaining elements to each of the portions of the tie means for individual sliding movement, sliding a plurality of the elements on each of the portions of the tie means toward the intersecting point formed by the primary component, and then securing the tie means with the elements gathered about the intersecting point formed by the primary component by securing the terminal ends of the tie means and forming an assembled decorative device.

13. The method of claim 12 wherein the attaching step further includes arranging each of the remaining elements on the tie means with upper faces of the elements uniformly facing upwardly in a common direction in a preassembled position, and wherein the sliding step includes sliding the elements from said preassembled position toward the primary element and into a ready position with the elements gathered on the tie means in adjacent relation to one another about the primary component.

14. The method of claim 12 wherein the joining step includes passing the tie means through the primary component with portions of the tie means crossing one another.

15. The method of claim 12 wherein the providing step includes providing tie means having a pair of ties, and wherein the joining step includes passing one of the pair of ties through a pair of slits in the primary component, and passing the other of the pair of ties through a second pair of slits in the primary component with the ties in crossing relation to one another.

16. The method of claim 15 wherein the attaching step includes weaving each of the ties through a pair of slits in the remaining elements being attached thereto.

17. The method of claim 16 wherein the joining and attaching steps include passing the respective ties through the slits of the elements with the tie overlying each element between its slits.

* * * * *